US006106199A

United States Patent [19]

Medeiros, Jr. et al.

[11] Patent Number: 6,106,199

[45] Date of Patent: Aug. 22, 2000

[54] PILE FOR ANCHORING FLOATING STRUCTURES AND PROCESS FOR INSTALLING THE SAME

[75] Inventors: Cipriano José de Medeiros, Jr.; Luis Hissashui Hassui, both of Rio de Janeiro; Rogério Diniz Machado, Macaé, all of Brazil

[73] Assignee: Petroleo Brasileiro S.A. -Petrobras, Rio de Janeiro, Brazil

[21] Appl. No.: 08/917,948

[22] Filed: Aug. 27, 1997

[30] Foreign Application Priority Data

Aug. 30, 1996 [BR] Brazil ..... 9603599

[51] Int. Cl.[7] ..... E02D 5/54; E02D 5/74; B63B 21/24

[52] U.S. Cl. ..... 405/224; 405/244; 114/294; 114/295; 114/311

[58] Field of Search ..... 405/224, 244, 405/233; 114/293, 294, 295, 296, 311; 52/153, 154, 158, 162, 163, 165

[56] References Cited

U.S. PATENT DOCUMENTS

| | | | |
|---|---|---|---|
| 2,583,985 | 1/1952 | Page, Jr. et al. | 114/295 X |
| 3,032,000 | 5/1962 | Feiler | 114/295 |
| 3,036,542 | 5/1962 | Robinson | 114/295 |
| 3,158,127 | 11/1964 | Gallaugher | 114/311 X |
| 3,170,433 | 2/1965 | Gardiner | 114/295 |
| 3,291,092 | 12/1966 | Halberg et al. | 114/295 |
| 3,315,629 | 4/1967 | Standridge et al. | 114/295 |
| 3,631,550 | 1/1972 | Bullen | 441/25 |
| 4,969,413 | 11/1990 | Abernethy | 114/294 X |
| 5,322,386 | 6/1994 | Trangsrud | 405/244 X |
| 5,463,971 | 11/1995 | Abernethy | 114/294 X |
| 5,704,732 | 1/1998 | Horton, III | 405/228 |
| 5,819,681 | 10/1998 | Barnes et al. | 114/294 |

FOREIGN PATENT DOCUMENTS

| | | |
|---|---|---|
| 8704412 | 8/1987 | Brazil . |
| 9002463 | 11/1991 | Brazil . |
| 9303646 | 8/1993 | Brazil . |
| 0640522 | 3/1995 | European Pat. Off. . |
| 886243 | 3/1989 | South Africa . |

*Primary Examiner*—Eileen Dunn Lillis
*Assistant Examiner*—Jong-Suk Lee
*Attorney, Agent, or Firm*—Sughrue, Mion, Zinn, Macpeak & Seas, PLLC

[57] ABSTRACT

A pile for anchoring a floating structure in deep water includes an elongated body provided with a tapered pointed tip at the lower end thereof and a closure disc at the upper end thereof. A plurality of radially and axially extending fins are secured to the pile adjacent the upper end thereof. The elongated body of the pile is filled with material having a high specific gravity distributed in such a manner that the center of gravity of the pile is located well below its center of buoyancy. The process for installing the pile uses the potential energy generated by the free fall of the pile from a vessel in order to ensure that the pile penetrates the ocean floor.

7 Claims, 7 Drawing Sheets

PILE FOR ANCHORING FLOATING STRUCTURES AND PROCESS FOR INSTALLING THE SAME

FIELD OF THE INVENTION

The present invention relates to an elongate pile with a closed tip for application in operations involving the anchoring of structures on the seabed, especially in places where it is impossible to use drag anchors.

BACKGROUND OF THE INVENTION

Floating structures for drilling for, and producing, petroleum are anchored on the seabed by means of drag plates or anchors, gravity structures, plates or piles which may be forced in, or by means of piles which are drilled and cemented in.

Piles which are forced in may be installed by means of pile drivers, blasting, or a suction system (applicable to short piles with a large cross section). During pile-installation operations, these forcing-in systems require special equipment, such as large support vessels or equipment which operates on the seabed, using hydraulic units controlled from service vessels.

When it is necessary to operate in places where the water is very deep, such operations become more difficult, lengthy and costly.

The object of the present invention is to provide a pile which is particularly suitable for application in the anchoring of floating structures in deep waters, and which can be forced into the ocean floor with the aid of simpler and cheaper devices than those available on the market, guaranteeing reliable results.

DESCRIPTION OF THE PRIOR ART

The technology relating to piles for fastening structures of the most varied types has been studied and consolidated for a long time. However, the development of piles for use on the ocean floor has, in recent years, made great progress, principally because it became essential to recover petroleum from offshore reserves and at great depths (close to 2000 meters below the sea surface).

The Applicant has been conducting studies with a view to making viable various types of tubular and closed-tip piles, these allowing highly reliable results together with a reduction in operating costs.

Brazilian Patent PI-704412-9 describes a pile designed specially for use on petroleum-exploration and -production platforms located in deep-water areas, the principal characteristic of this pile being the closure of the tip of the pile, consisting of an axisymmetrical shell with a thick wall of conical shape, so as to be capable of enabling the pile to penetrate into the ocean floor while maintaining its structural integrity.

Brazilian Application PI-9002463-0 describes a type of pile for the foundation of platforms, known as a "gravity pile", which comprises two concentric tubes whose annular space is filled with a composition with a high specific gravity, and having, at equidistant intervals, cast or forged rings with a constriction in their central part.

Brazilian Application PI-9303646-9 presents a foundation system for tension-leg platforms, in which the stays are anchored directly in a receptacle mounted inside a pile forced into the ocean floor, dispensing with the use of rigid foundation structures.

The present invention is the result of a continuation of previous studies, focusing on the simplification of operations for installing the actual pile and also on a reduction in costs.

SUMMARY OF THE INVENTION

A first aspect of the present invention relates to a pile for anchoring floating structures in deep and very deep waters which comprises: an elongate body, provided with a tapered pointed tip at its lower end and a closure disc at its top end; vertical fins close to the top of said body; and material of high specific gravity distributed within the interior of the elongate body in such a manner that the centre of gravity of the pile is located well below its centre of buoyancy.

A second aspect of the invention provides a process for installing the pile of the first aspect, using the potential energy generated by the free fall of the pile from a vessel to ensure it penetrates into the ocean floor. Preferably the pile descends from a vessel down to a predetermined depth above the seabed while supported by hawsers or cables, then said hawsers or cables are released, and the pile is thus allowed to descend in free fall and to penetrate into the ocean floor after impact on the seabed.

BRIEF DESCRIPTION OF THE DRAWINGS

To make it easier to understand, the invention will be described with reference to the accompanying drawings in which.

DETAILED DESCRIPTION OF THE INVENTION

Figure 1:
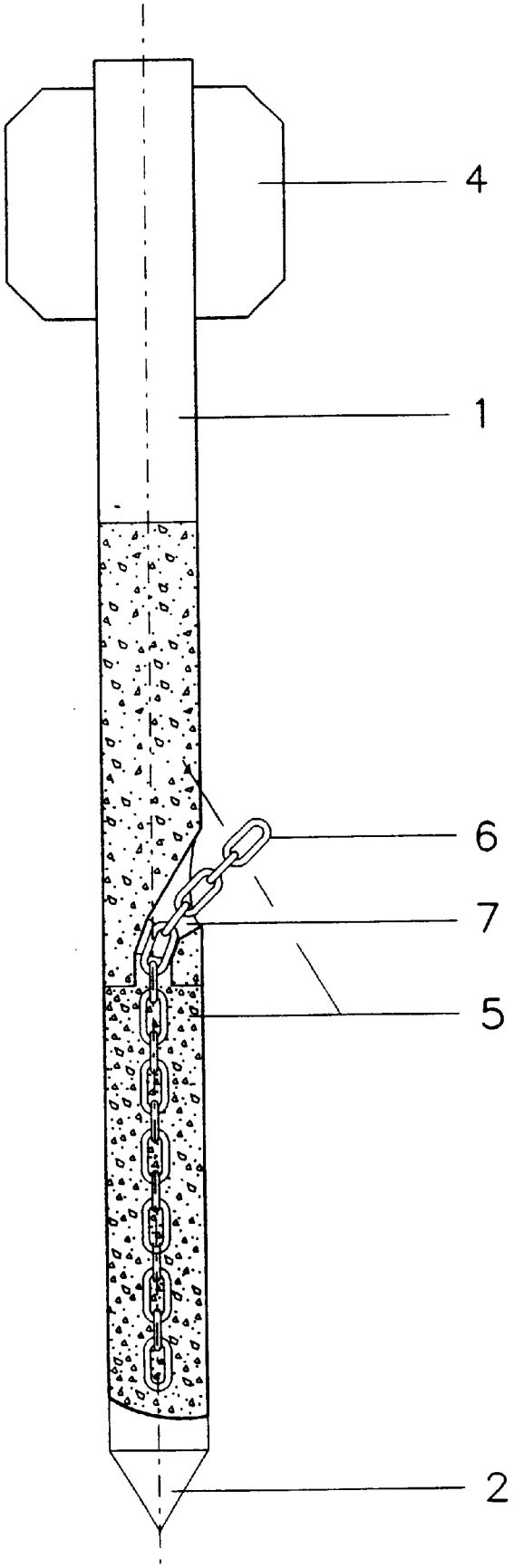
FIG. 1 shows diagrammatically a first embodiment of the pile of the invention.
Figure 2:
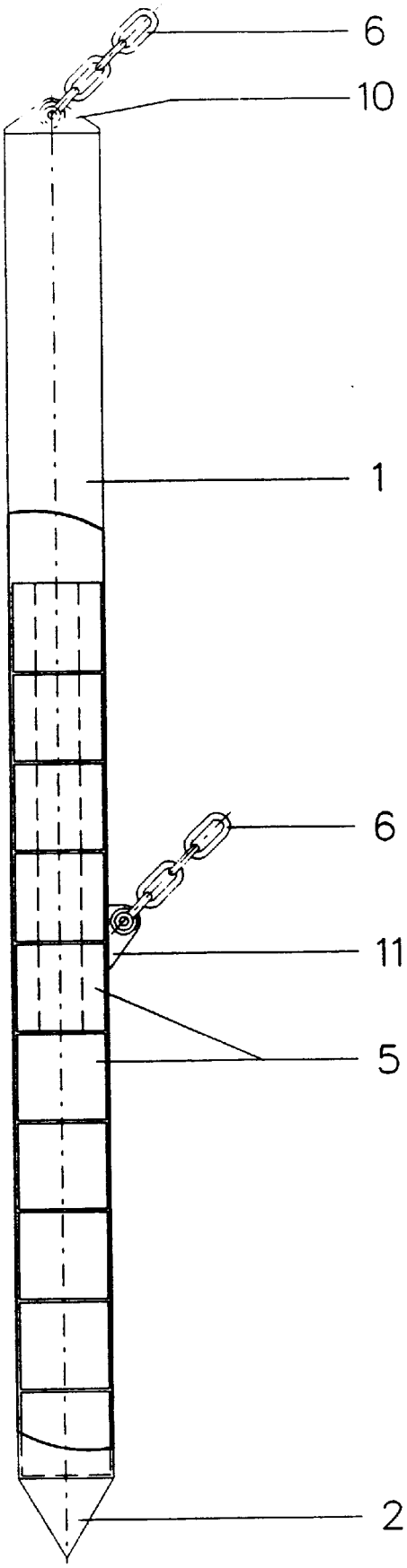
FIGS. 2 and 6 show diagrammatically further embodiments of the pile of the invention.
Figure 6:
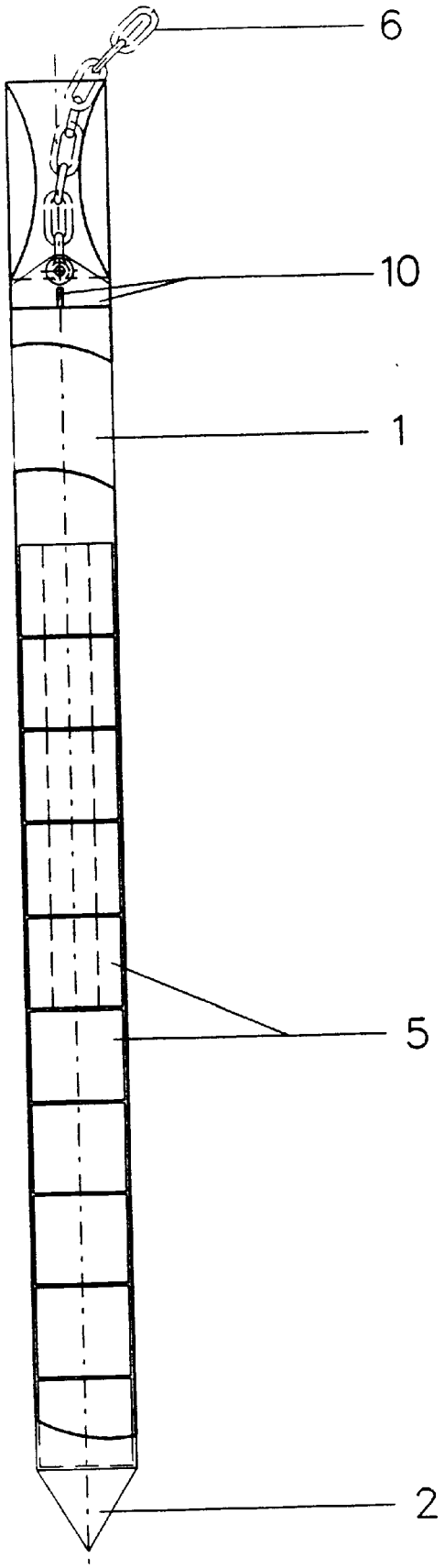
Figure 7:
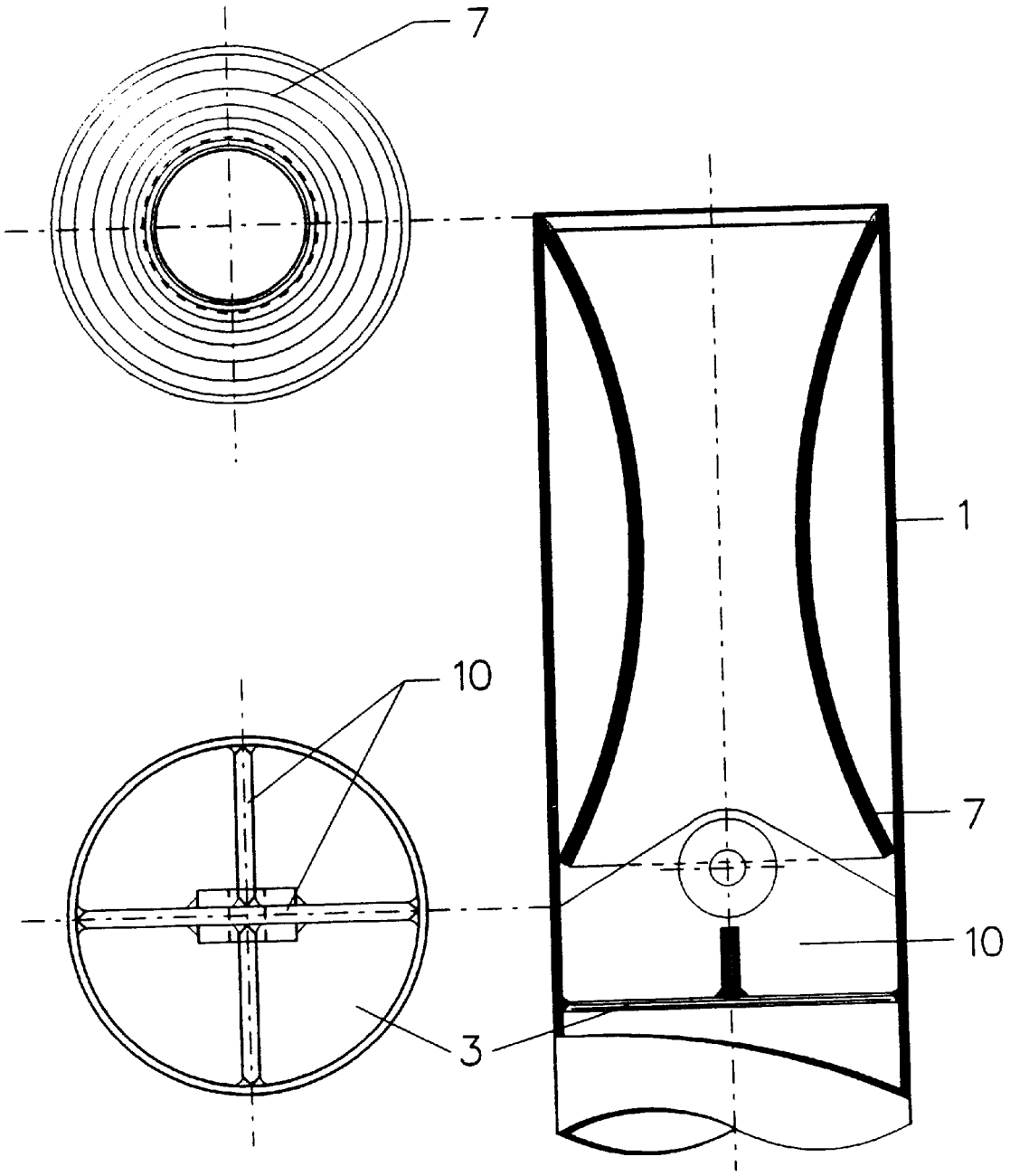
FIG. 7 shows, in detail, the closure disc of the pile of the invention.

As may be seen in FIGS. 1, 2 and 6, the pile basically comprises an elongate body 1, provided at its lower end with a tapered pointed tip or 2 and at its upper end with a closure disc 3 shown in detail in FIG. 7. In order to guarantee its stability during the descent to the seabed 15 the pile also has a plurality of vertical fins 4 close to the top. The interior of the elongate body 1 is filled with ballast material of high specific gravity, such as, for example haematite, heavy concrete, cast iron, etc., this ballast 5 being distributed in such a manner that the centre of gravity of the assembly is located at a point which is as low as possible with respect to the centre of buoyancy of the pile.

This distribution of ballast may be obtained in different ways. The embodiments illustrated in FIGS. 1, 2 and 6 are presented merely by way of example.

In FIG. 1, the elongate body 1 is filled with heavy concrete in the lowest portion, and with lighter concrete in the intermediate portion, but the upper portion remains empty.

In the embodiments illustrated in FIGS. 2 and 6, the ballast consists of cylinders of cast iron; the cylinders in the lower portion are solid, but empty cylinders are used in the intermediate portion, and the space in the upper portion is not filled. In all cases, the upper end of the elongate body is closed by a disc 3 (FIG. 7) welded on its upper end.

It will be obvious to a person skilled in the art that it is possible to apply other possible combinations, with diverse materials and arrangements, always with the objective of lowering the centre of gravity of the pile. Nevertheless, such combinations will be included within the scope of the invention.

In order to link the pile to the anchoring line, use is made of cables or hawsers 6 consisting of chains. The hawsers may be connected to the body of the pile in various ways.

If the ballast 5 is made from concrete, the hawser 6 may be concreted inside the elongate body 1 and may exit via a side opening 7 similar to the hawseholes which exist in the sides of ships to allow anchors to be dropped; this allows the hawser to be stressed by a force acting in any direction. This situation is shown in detail in FIG. 3. To offset the reduction in the cross-section of the pipe 1, provision is made for an internal reinforcement 8 (in FIGS. 3 and 4) in the region of the side opening 7.

When the pile is filled with another material, use may also be made of the same type of hawsehole, but the link between the hawser 6 or cable and the pile will be achieved by means of welding of pins or flanges fastened to an eyelet 9, as illustrated in the Figures.

Figure 3:
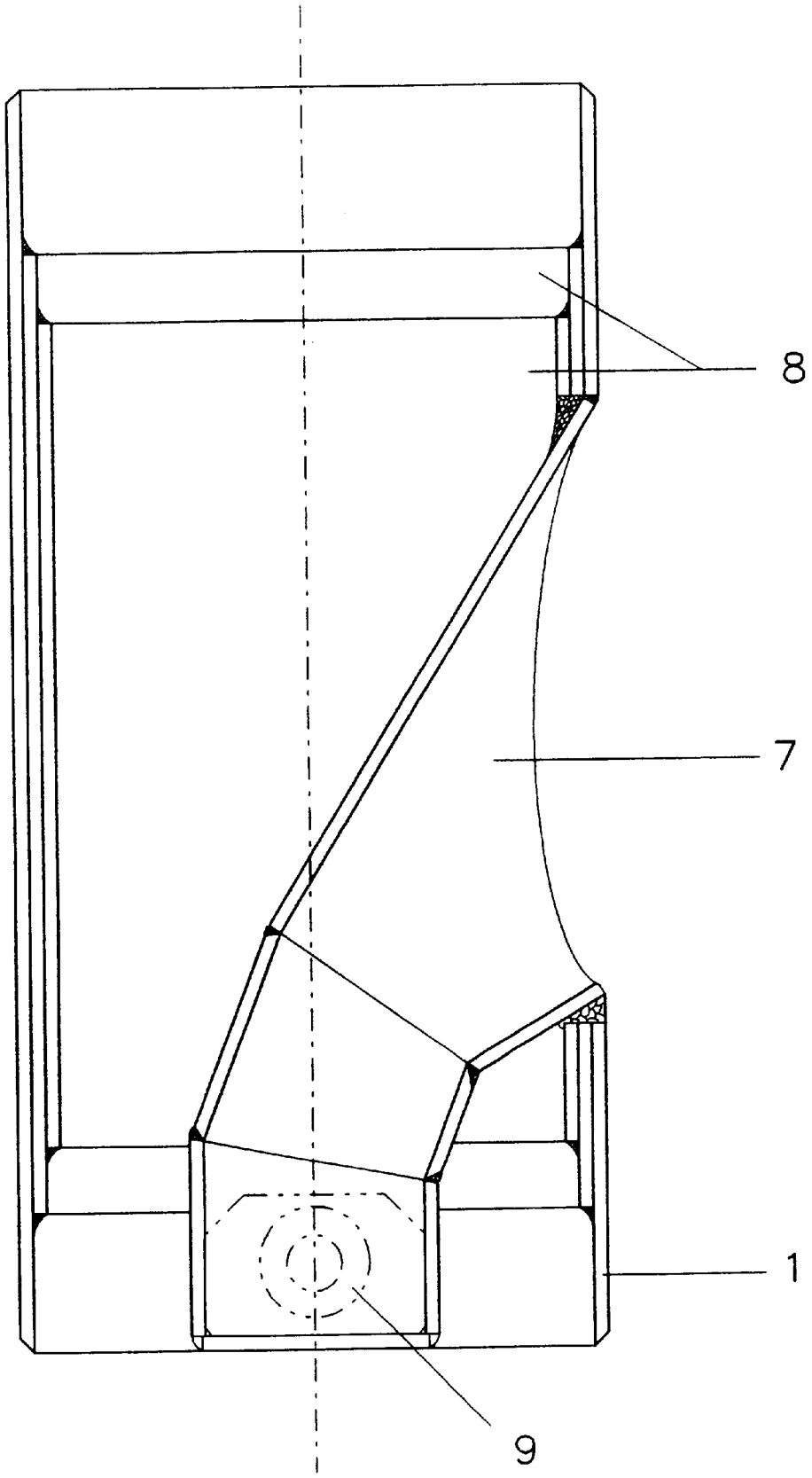
FIGS. 3 and 4 show details of two similar forms of the connection of the hawser to the pile.
Figure 4:
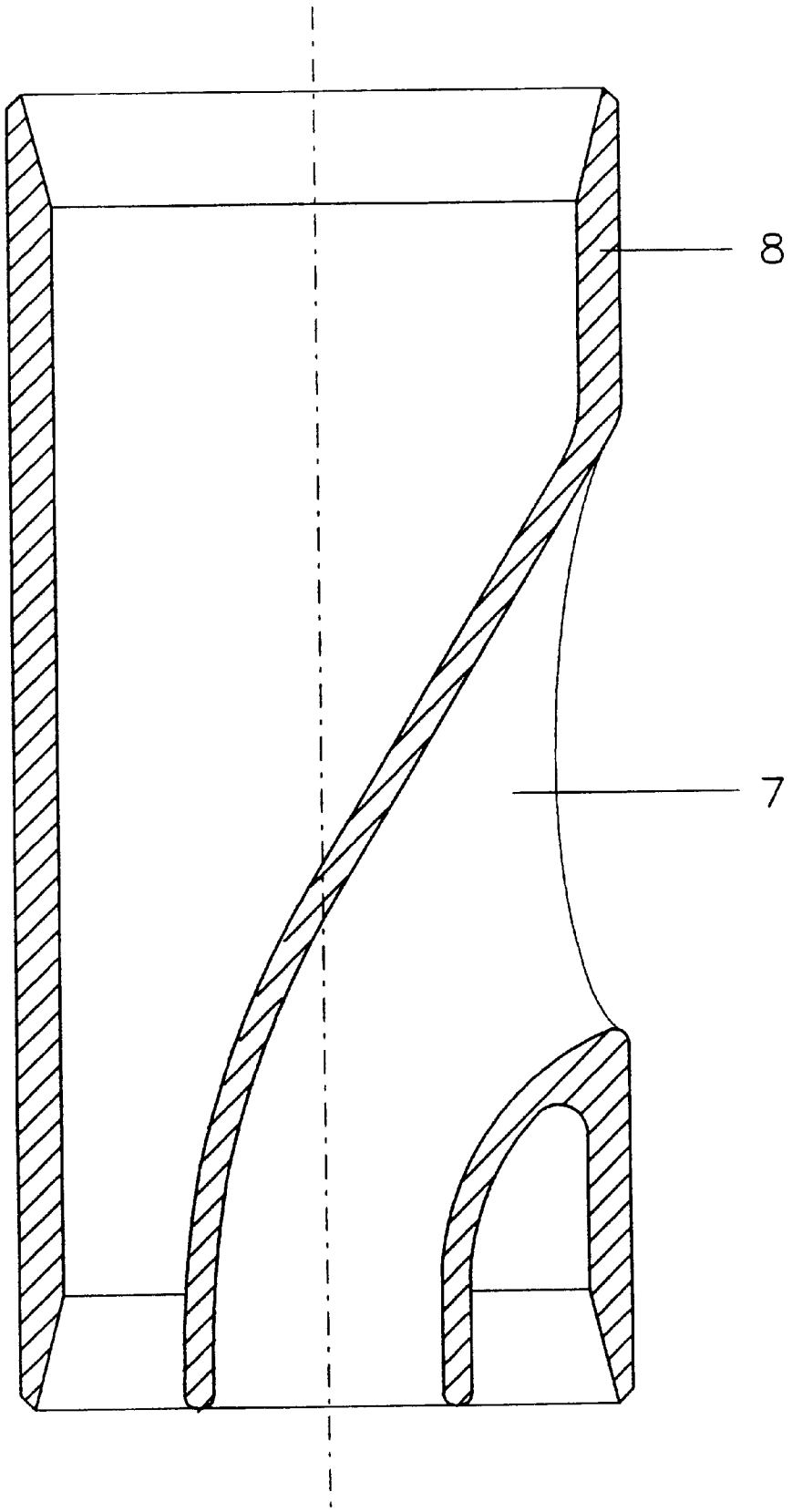

The hawseholes mentioned above may, as appropriate, be constructed with tubes and welded plates as in FIG. 3, or with cast or forged steel as in FIG. 4.

A further possibility consists in making the connection by means of an eyelet 10 fixed to the top of the pile and/or an eyelet 11 fixed to an intermediate section of the elongate body 1 as shown in FIGS. 2 and 6. Even with this type of fastening, the pile may be equipped with a hawsehole 7 at its upper end as shown in FIGS. 6 and 7 to allow the hawser or cable to exit in any direction.

Both the type of ballast to be used and the way in which the hawsers or cable are connected to the pile depend on (i) the desired penetration of the pile into the ocean floor, (ii) the method of installation of the pile and (iii) the anchoring load capacity required by the structure.

The process for forcing-in the pile used by the present invention offers the advantages of precision in application and simplicity in operation. It is based on the concepts of launching a body in free fall, and applying the potential energy generated by the descent of the pile to achieve its penetration into the ocean floor.

The pile is launched with the aid of a vessel, for example a tug. The pile is lowered down to a predetermined depth above the seabed, supported by hawsers 6 or cables, and is then released and allowed to fall in free fall. The height of the free fall is calculated so as to ensure that the pile reaches the ocean floor at a speed which is sufficient to force it in by the desired distance. For example, the cylindrical shape with a conical tip, which is reminiscent of a torpedo, minimizes the resistance to displacement in the water and in the ocean floor, allowing a speed which increases during the free fall and achieving effective penetration into the ocean floor after impact on the seabed. The vertical stabilizing fins 4 and the suitable distribution of the ballast 5, locating the centre of gravity well below the centre of buoyancy, prevent the pile from tumbling during its fall. The fins 4 are straight (i.e. they extend radially outwardly from lines parallel to the axis of the pile). However when the cable or hawser 6 extends through the upper end of the pile they could be shaped to induce rotation of the falling pile about its axis.

Figure 5:
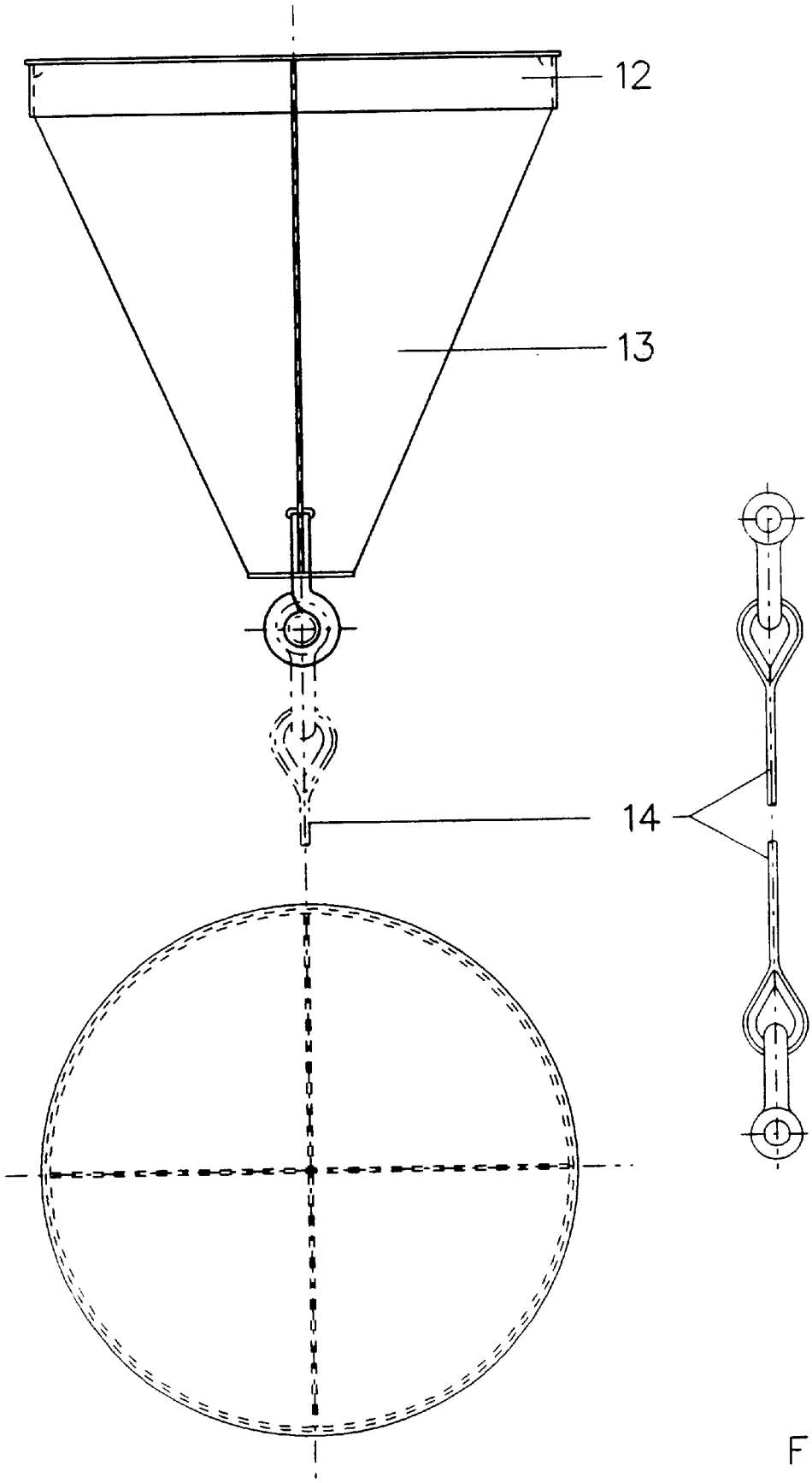
FIG. 5 shows the drogue device for limiting the descent speed of the pile.

The need may arise to launch the pile from any height above the ocean floor which confers a speed on the pile which is above that required to force it in. In such a case, the maximum speed to be developed by the pile may be limited by the use of a hydrodynamic drag (or drogue) device, which may or may not form part of the body of the pile, such as, for example, the device shown in FIG. 5.

The speed-limiting device comprises a braking disc formed by a solid disc 12 linked to a system of vertical (axial) fins 13 and connected to the top of the pile, or to the top hawser (shown in FIG. 2), by means of a cable 14. The diameter of the disc 12 is a function of the maximum speed desired for the pile and will be defined after hydrodynamic analysis of the system.

Limitation of the speed may also be obtained by (i) controlling the weight and the external dimensions of the pile, (ii) varying the specific gravity, i.e. the material used as ballast, or (iii) varying the section and the length of the elongate body during hydrodynamic analysis in free fall and during geomechanical analysis upon penetration into the ocean floor. If the torpedo configuration is selected as a function of the maximum speed in free fall within the water, launching may take place from the sea surface, which considerably simplifies operations in the field.

What is claimed is:

1. A pile for anchoring floating structures is comprised of an elongated tubular body having a lower end with a tapered pointed tip and a closure disc secured to an upper end of the pile, a plurality of vertically extending fins secured to said pile adjacent the upper end of the pile, a ballast comprised of a material of high specific gravity disposed within the tubular body to provide a center of gravity for the pile, located in the lower end of said pile and a hawsehole provided with connecting means within the hawsehole for connection to a hawser.

2. The pile according to claim 1, wherein said hawsehold is secured to a side of the tubular body and provided with internal reinforcements.

3. The pile according to claim 1, wherein said connecting means is an eyelet secured to said closure disc for connection to said hawser.

4. The pile according to claim 3, wherein the closure disc is recessed within the upper end of the tubular body and said hawsehole is provided within the upper end of the tubular body for guiding said hawser connected to said eyelet.

5. The pile according to claim 1, further comprising a speed-limiting device comprised of a flat disc having a plurality of axially and radially extending fins secured to an undersurface of the solid disc and a cable connecting said speed-limiting device to said pile.

6. A process for installing a pile according to claim 1, comprising lowering the pile while supported by said hawser to a predetermined depth, releasing said pile from said hawser and allowing said pile to descend in free fall and penetrate into the ocean floor upon impact.

7. The process according to claim 6, further comprising the step of using a speed-limiting device for controlling the maximum speed to be achieved by the pile in free fall.

* * * * *